US005702033A

United States Patent [19]

Beaver

[11] Patent Number: 5,702,033

[45] Date of Patent: Dec. 30, 1997

[54] ADJOINED DUAL-TUBE DISPENSER

[75] Inventor: Ted L. Beaver, Roselle, Ill.

[73] Assignee: Continental Plastic Containers, Inc., Norwalk, Conn.

[21] Appl. No.: 479,942

[22] Filed: Jun. 7, 1995

[51] Int. Cl.[6] ..... B65D 35/22

[52] U.S. Cl. ..... 222/94; 222/145.3; 222/556

[58] Field of Search ..... 222/94, 107, 129, 222/145.3, 556

[56] References Cited

U.S. PATENT DOCUMENTS

| | | | |
|---|---|---|---|
| 3,506,157 | 4/1970 | Dukess | 222/94 |
| 3,581,940 | 6/1971 | Cella | 222/94 |
| 3,866,800 | 2/1975 | Schmitt | 222/94 |
| 4,693,395 | 9/1987 | Tavss et al. | 222/107 |
| 4,964,539 | 10/1990 | Mueller | 222/94 |
| 4,974,756 | 12/1990 | Pearson et al. | 222/562 |
| 4,989,758 | 2/1991 | Keller | 222/137 |
| 5,318,203 | 6/1994 | Iaia et al. | 222/94 |
| 5,386,918 | 2/1995 | Neveras et al. | 222/556 X |

FOREIGN PATENT DOCUMENTS

| | | | |
|---|---|---|---|
| 2453453 | 5/1975 | Germany | 222/94 |
| 2224309 | 5/1990 | United Kingdom | 222/556 |

*Primary Examiner*—Joseph Kaufman
*Attorney, Agent, or Firm*—Eugene F. Friedman

[57] ABSTRACT

A dispenser with adjoined dual tubes for providing a combination of ingredients which remains separate from each other during storage. The compartments, at one end, taper to a restricted opening adjacent to each other. Each of the openings has a shape generally of a D, with the straight ends of the D's lying next to each other. The tapering of the openings creates a nozzle of these orifices. This tapering nozzle then fits directly into a single opening in the bottom section of a hinged cap. From there they dispense the product directly. In their manufacture, for example through extrusion-blow molding, the bottom ends of the two compartments connect to an integrally formed plenum. This common plenum facilitates the molding of the dispenser from a thermoplastic. The finishing of the tube involves the removal of the common plenum. After filling, the bottoms of the two tubes may undergo heat sealing to close them and to connect them together.

67 Claims, 2 Drawing Sheets

ADJOINED DUAL-TUBE DISPENSER

BACKGROUND

The use of dual-compartment containers has experienced a substantial increase over the past few years. The container provides a product having separate components which react, when mixed, to achieve a desired result. Thus, a cleaning solution or dentifrice may include hydrogen peroxide that reacts with the ingredient in the other compartment to achieve increased cleansing. As a further example, the components of an epoxy-resin adhesive must remain separate from each other until their time of actual use.

A problem concerning the containment of reactive ingredients in separate but adjoined tubes centers, of course, upon the tubes' openings. These must occur in the immediate vicinity of each other. This allows the dispensing of the two ingredients in the same general area where they may combine and react. However, placing the openings of the two compartments near each other portends the possibility, if not likelihood, of their premature combination and reacting, leaving them in an undesirable, if not unsuitable condition, for their intended subsequent use.

The dual-compartment tube, of course, utilizes a cap to effectuate closure. Typically, a cap has a lower section with a divider which will maintain the separate identity of the two component streams until their disbursement from the container. An upper portion of the cap serves to actually close the two streams from the exterior. This portion too will have, typically, a divider that keeps the two streams separate from each other with the cap closed.

The necessity for the cap to assist in maintaining the separate identity of the two component streams then imposes a requirement for angular registration between the cap and the two compartments of the dispenser. In other words, the cap must have a proper orientation relative to the dispenser so that it can properly help maintain the two streams separate from each other. Achieving this proper orientation, or registration, them limits the manner in which the cap may attach to the dispenser. Typically this involves a clip-on connection in which the cap snaps onto or into the dispenser.

U.S. Pat. Nos. 3,581,940 to J. A. Cella; 3,866,800 to W. H. Schmitt; and 5,318,203 to M. J. Iaia et al. show two-section caps in which one section actually enters into the dispenser tubes to keep the two streams of components separate from each other. The upper cap section aligns with the lower section to maintain the barrier between the streams. The lower cap section must then register correctly with the dispenser compartments in order to provide the conduits to the exterior that maintain the streams separate from each other. The Iaia et al. patent shows merely a two-section cap in which the base section must clip onto the dispenser's compartments. The Cella and Schmitt patents have caps with more than two sections. One section inserts into the separate compartments; a further section fits over the first, screws onto the dispenser, and keeps the first in place. A further section then travels into the second section to either close off the component streams, or, when extended, provide a pathway to the exterior.

W. C. Pearson et al. in their U.S. Pat. No. 4,974,756 and W. A. Keller in his U.S. Pat. No. 4,989,758 both show dual-component dispensers which have caps that extend substantially into the dispenser's compartments themselves. The caps then either remain in place simply by a friction hold or, in the case of Pearson et al., through an exterior clip which may grab hold of ridges.

The U.S. Pat. No. 4,964,539 to B. M. Mueller shows a dual-compartment container in which a divider wall separates the various components within the container. The separator wall then extends well beyond the end of the container's neck. The base section of the cap then fits onto the neck and cooperates with the extended septum to form separate paths for the different components. An upper cap section registers with the separating septum to block the two streams from each other while stored in the container. Again, the cap must register properly with the container on which it sits.

Dispensing systems which can maintain two components separate from each other until exuded have become beneficial and widely used. However, the cap enclosing such dispensers have involved complicated, expensive and, at times, unreliable closures. Accordingly, the search continues for dispensing systems, methods for making such systems, and closures that will prove less expensive and more reliable.

SUMMARY

Providing tapered outputs of the two compartments of a dual-tube dispenser can achieve several benefits. They may act as the actual outlet for the separate compartments, thus eliminating the need for any cap to achieve that function. Furthermore, when using a cap having lower and upper sections, they do not require either section to cooperate with the dispenser to ensure the separation between the components. This obviates the necessity for registration between the cap and the container. In turn the cap may attach to the container through the use of a helical screw thread.

Stated in general terms, a dual-tube dispenser includes two elongated tubes held in close proximity to each other. Their elongated dimensions lie alongside each other. One end of each of the tubes has an opening with each of the tubes tapering to its opening.

As a dispenser by itself, the openings may be defined by a wall having an exterior surface in the shape generally of a D. The ends of the D's generally lie in a plane to provide the dispenser outlet. The straight edges of the D's of the two tubes generally occur adjacent to each other to provide an overall circular exterior configuration of the combined outlet. The tube should then taper gently to the outlet which then acts in effect as a nozzle dispenser to dispense the product.

Alternately, the dual-tube dispenser may find use in conjunction with a cap having two sections. Each of the tubes in this case tapers to its separate opening.

The cap in turn has a first section with an opening passing through it. A second section of the cap includes a closure device. When the second section occupies a first position relative to the first section, it closes the opening through that first section. A coupling device, which itself couples to the first and second sections of the cap, holds the second section of the cap in its first position in which it can close the opening in the first section. It also permits movement of the second, or upper, section of the cap relative to the first section to leave the opening in the lower section open for the dispensing of the components within the tubes.

An affixing device then couples to the tubes and the cap. It holds the lower cap section to the tubes at a location near the ends of the tubes with the openings. The tapered ends of the tubes then pass substantially through the opening in the lower cap section when held at its location by the affixing device. The taper on the ends of the two tubes allows them to pass through the opening in the lower section of the cap, act as nozzles, and dispense the product contained within the tubes. This permits the tubes to dispense their contents directly from their openings without the requirement of any septum or separation provided by the lower section of the cap. Furthermore, it similarly does not require the upper section of the cap to provide a barrier between the two compartments since they remain separate from each other to the point in which they dispense their product.

A facile method of making a dual-tube container involves the production of an intermediate tube having the nondispensing ends of the two tubes connected to a common plenum, or chamber. This tube, with the common chamber coupling to the nondispersing ends of the two tubes, assures that the force creating the tubes, such as gas pressure in blow molding, reaches all sections of the two tubes equally to produce a reliable product.

The intermediate tube has its two compartments and the common chamber at the nondispensing ends. The two elongated tubes attach together along their elongated dimensions. One end of each of theses tubes should have an opening with the openings of these one ends lying generally near to each other. The dual-compartment tube has a common chamber with a fluid-tight coupling to the other ends of each of the elongated tubes.

To provide separate compartments, the common chamber must undergo removal from the nondispensing ends of the elongated tubes. The closing of the ends of the elongated tubes would typically occur after they receive their compliment of separate components which they will eventually dispense. The closing of these ends provides the finished dispenser.

DETAIL DESCRIPTION

Figure 1:
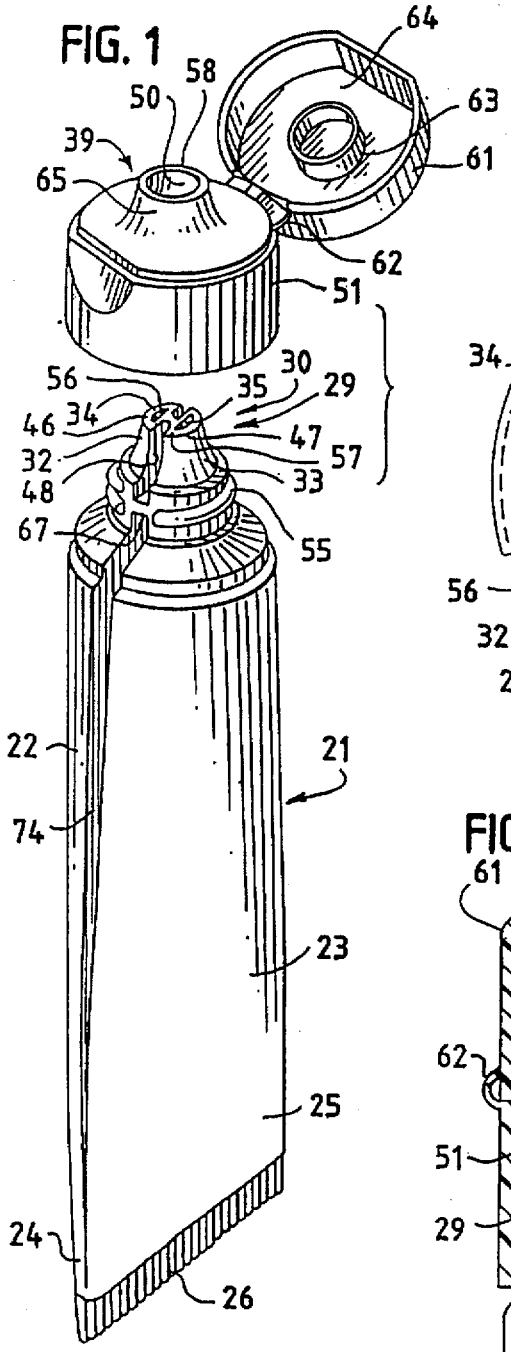
FIG. 1 provides an exploded, isometric view of a dual-tube dispenser having a tapered outlet with a screw-on cap.

FIG. 1 shows a dual-tube dispenser generally at 21 having the two elongated tubes, or compartments, 22 and 23. The two compartments 22 and 23 hold the separate components of a product such as an epoxy resin or a toothpaste. The bottom ends 24 and 25 of the compartments 22 and 23 incorporate the seal 26 which closes off both compartments. The seal 26 also attaches the bottom ends 24 and 25 together.

Figure 2:
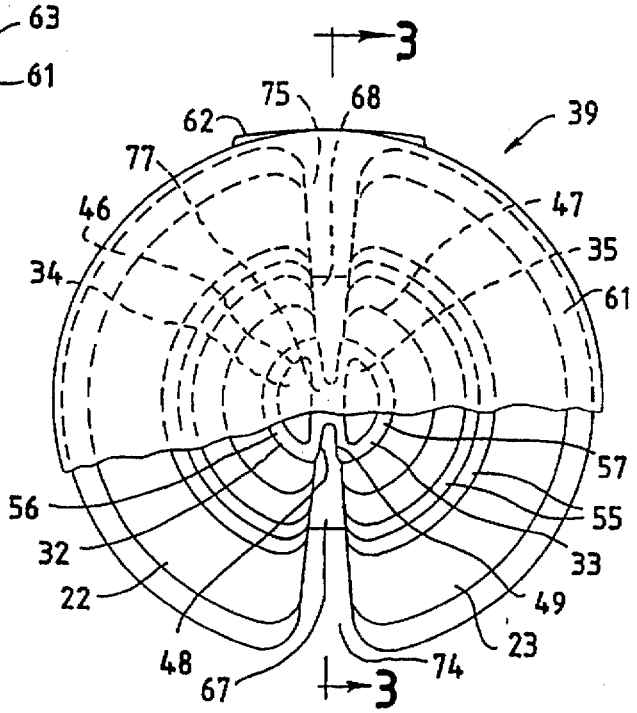
FIG. 2 gives a top plan view, partially in section, of the dispenser and cap of FIG. 1.
Figure 3:
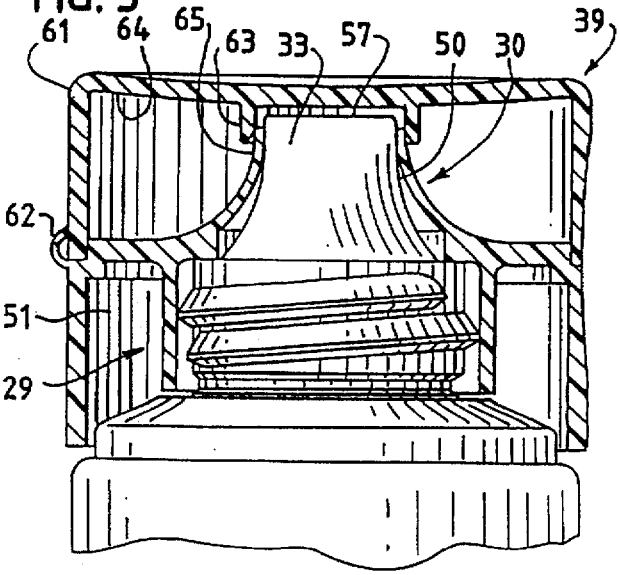
FIG. 3 provides a cross-sectional view along the line 3—3 of the cap and the top portion of the dispenser of FIG. 2.
Figure 4:
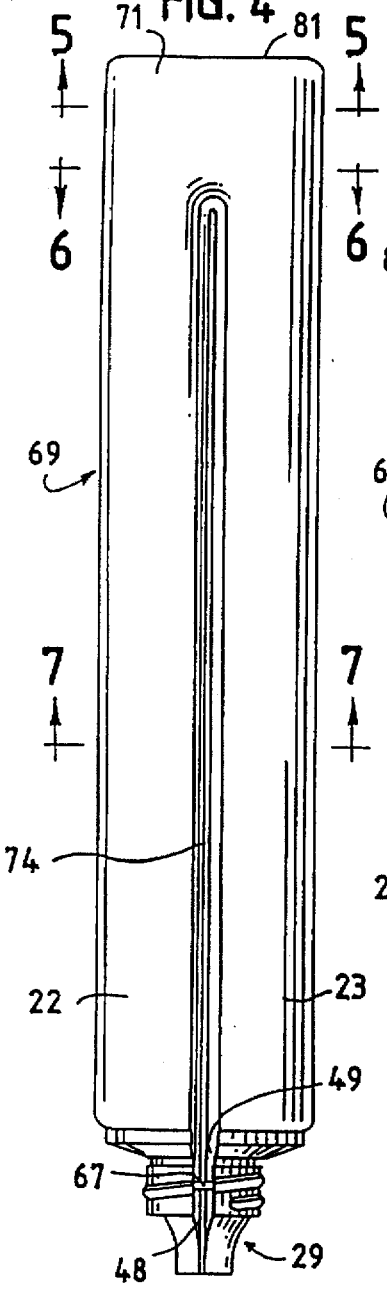
FIG. 4 gives a side elevational view of a dual-tube dispenser after its formation with the two compartments adjoined to a common chamber.

As seen in FIGS. 1 to 3, the other end 29 of the container 23 permits the dispensing of the ingredients contained in the compartments 22 and 23. Specifically, the tubes 22 and 23 attach to the nozzle generally indicated at 30 composed of the two halves 32 and 33. The two halves 32 and 33 of the nozzle 30 taper to the two openings 34 and 35, respectively. As discussed below, the surfaces 32 and 33 have a gentle curving taper which allow them to fit into an opening in the cap indicated generally at 39.

The exterior surfaces 46 and 47 of the two nozzle halves 32 and 33 take the shape of D's. Their straight edges 48 and 49 lie adjacent to each other. This gives the two D's formed by the outer surfaces 46 and 47 and the generally straight edges 48 and 49 an overall circular configuration. This permits them to fit readily into the circular opening 50 on the lower section 51 of the cap 39. The end 29 of the tube 21 includes the screw thread 55 located between the tapering sides 32 and 33 and the two bodies 22 and 23, respectively. This permits the attachment of the lower section 51 of the cap 39 by screwing onto the end 29 of the dispenser 21. The exact circular orientation of the cap 39 relative to the dispenser 21 has no special importance. The ends 56 and 57 of the D's 34 and 35 extend to the ridge 58 of the circular opening 50 in the lower section of the cap 51. It accordingly will allow the proper operations of the two D outlets 32 and 33 regardless of the relative circular orientation between the tube 21 and the lower section 51 of the cap 39. Screwing the cap 39 onto the tube 21 serves to tightly attach the former to the latter. It prevents the accidental removal of the cap 39 by a slight pulling motion.

The upper section 61 of the cap 39 attaches through the hinge 62 to the bottom half 51. The closed cylinder 63 on the inner surface 64 of the upper cap section 61 covers the protruding cylinder 65 of the lower cap section 51. This cylindrical section 63 serves to close the protrusion 65 in the lower section 51 of the cap 39 and thus the two D's 32 and 33 of the end 29 of the dispenser 21. The ends 56 and 57 of the D's 32 and 33 extend virtually to the top ridge 58 of the protrusion 65 in the lower cap section 51. This allows the direct dispensing of the ingredients from the compartments 22 and 23 to the desired location. It also permits the direct closure of the D's 32 and 33 by the upper cap section 61.

The ribs 67 and 68 sit between the two halves 32 and 33 of the nozzle 30 of the tube 21. These ribs stiffen the area of the screw threads 55 to prevent them from folding upon each other between the halves 32 and 33. Were that to happen, the screw threads 55 could possibly condense and permit the removal of the cap 39 from the dispenser 21.

The production of the dispenser 21 commences with the formation of the preliminary unit indicated generally at 69 in FIGS. 4 to 7. The preunit 69 includes the two compartments 22 and 23 of the dispenser 21 in FIG. 1. However, the two compartments 22 and 23 connect to the common chamber 71 at their nondispensing ends. The chamber 71 finds use in the formation of the preunit 69.

The preunit 69, and thus the dispenser 21, may have a composition of any suitable material. A polymeric resin would appear especially propitious. The use of a thermoplastic permits the formation of the preunit 69 by any of the usual molding techniques. Blow molding, especially following the extrusion of the tube of molten plastic, would have a special advantage in making the preunit 69.

Virtually any moldable thermoplastic will readily find use in making the preform 69 and thus the dispenser 21. Polyethylene has experienced wide use in such containers, as have polypropylene, polyethylene terephthalate, and polyvinyl chloride. Alternately, the container may have laminated walls containing several layers. These layers can include, again, polyethylene or most any other moldable resin including those listed above. It may also incorporate an oxygen barrier of which EVOH represents the usual example. In this case, additional layers of adhesive may prove desirable to avoid the delamination of the walls. Additionally, one or more of the layers may include a regrind or even a post-consumer recycled plastic.

Figure 6:
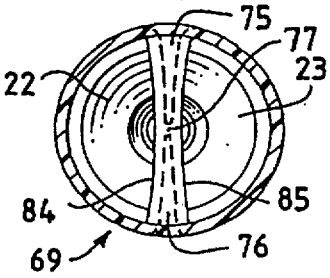
FIG. 6 gives a cross-sectional view along the line 6—6 of the dispenser with attached common chamber of FIG. 4.
Figure 7:
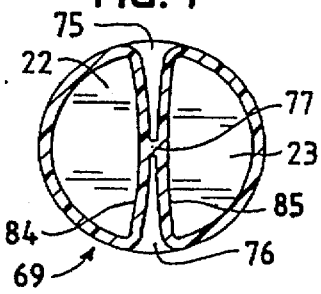
FIG. 7 provides a cross-sectional view along the line 7—7 of the dispenser with attached common chamber of FIG. 4.

Returning to FIG. 4, the formation of the preform 69 would typically involve the extrusion of a tube of molten plastic. This may take place either inside or outside of the final mold, but the latter avoids the necessity of cooling and reheating the plastic. In either event, once inside the mold and at a molten temperature, the application of gas pressure to the interior of the extruded tube serves to inflate the tube and move the plastic walls towards the surface of the mold. At this point, metal inserts may start moving towards each other into the molten plastic to form the creases 74 and (in FIGS. 2, 6 and 7) 75. The metal inserts continue to move towards each other until the plastic from each side in the creases of 74 and 75 meets along the center line 77 as seen in FIGS. 2, 6, and 7. This results in the formation of a seal between the plastic compartments 22 and 23 from opposite sides along the center 77 of the preform 69.

Figure 5:
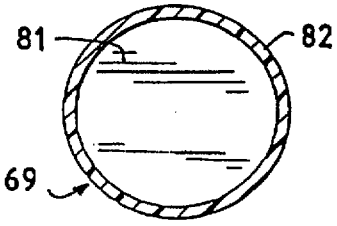
FIG. 5 has a cross-sectional view along the line 5—5 of the dispenser of FIG. 4 showing in particular the common chamber.

The joinder of the two creases 75 and 76 along the center line of the preform 69 and the inflation of the tube of molten plastic to the full dimensions of the mold result in the preform 69 in FIGS. 4 to 7. As seen there, the preform 69 includes the common chamber 71 formed integrally and in fluid communication with the compartments 22 and 23. Near the end 81 of the preform 69, the common chamber 71 may have the circular cross section 82 as seen in FIG. 5. The exact shape of the wall 82 has very little significance since it will not form part of the final dispenser. However, the common chamber 71 permits the free flow of gas under pressure between the compartments 22 and 23 to permit the facile and dependable production of the preform 69 through blow molding.

The compartments 22 and 23, at this point, have the separate interior walls 84 and 85 respectively which result from the formation of the creases 75 and 76 as most clearly seen in FIGS. 6 and 7. The interior walls 84 and 85 of the compartments 22 and 23 connect to each other along the center line 77. The center line 77 runs down the center of the preform 69 and also the final dispenser 21 and serves to hold the two compartments 22 and 23 together. The line passes all the way through the end 29 of both the preform 69 and the dispenser 21. There it keeps the two openings 34 and 35 in the integrally formed D-shaped surfaces 46 and 47 together. This permits the two components of the dispensed product to exit the container 21 together.

Figure 8:
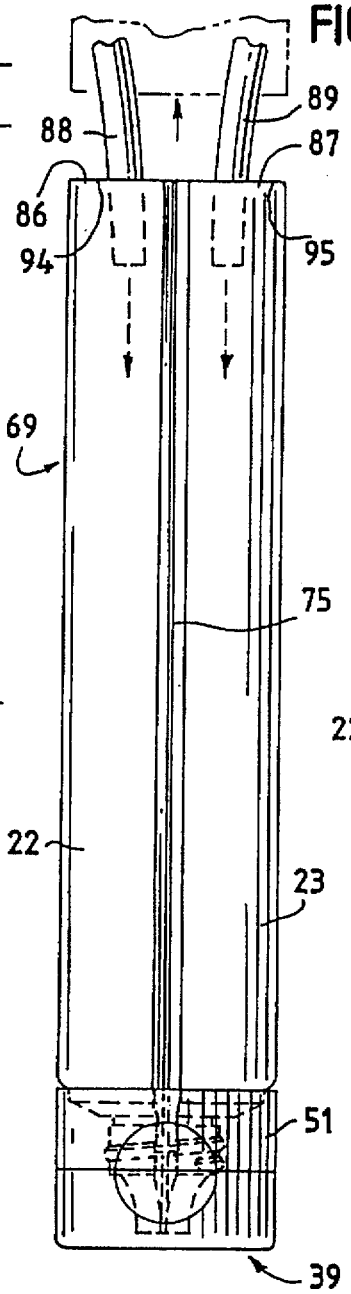
FIG. 8 shows the dispenser of FIG. 4 undergoing filling with its components after both the removal of the common chamber and the attachment of a two-section cap.
Figure 9:
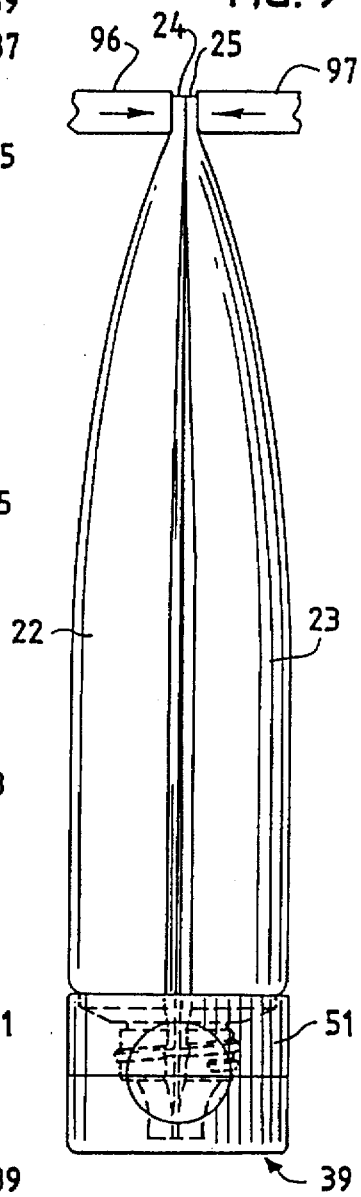
FIG. 9 shows the dual-compartment dispenser of FIG. 8 depicting the sealing of the open ends of the two compartments after they have received their contents.

The further utilization of the preform 69 commences with the removal of the common chamber 71. A sharp knife or edge may simply sever it. Thus should take place at a location where it will intersect the creases 74 and 75 to provide two separate compartments as seen in FIG. 8. This produces the open ends 86 and 87 for the compartments 22 and 23 and allows for the insertion of the feeder tubes 88 and 89 into the compartments 22 and 23, respectively. The compartments 22 and 23 then receive their separate components from the tubes 88 and 89 in the specified amounts.

The preform 69 in FIGS. 4 to 8 suggest that the two compartments 22 and 23 have substantially equal volumes. However, adjusting the location of the creases 75 and 76 will permit the construction of a preform and thus a dispenser having compartments of unequal volumes. Further, changing the mold can even produce a dispenser having more than two chambers.

After the compartments 22 and 23 have received their charges of the respective components, their ends 94 and 95 may be closed to seal off the openings 86 and 87, respectively. In the case of a thermoplastic, the heated mandrels 96 and 97 may approach each other to fuse the ends 24 and 25 together. This serves to both close the ends of the compartments 22 and 23 and seal them together to provide the unitary dispenser 21 of FIG. 1.

Accordingly, what is claimed is:

1. A dual-tube dispenser comprising two elongated tubes held in close proximity to each other with their elongated dimensions alongside each other, one end of each of said tubes having an opening defined by a wall with an exterior surface with the ends of said walls forming substantially a plane with both said openings being held substantially adjacent to each other, said tubes tapering gently to said one ends of said tubes, and said one end of each of said tubes being integral with a substantial portion of the remainder of its respective tube.

2. The dispenser of claim 1 wherein said exterior surfaces of said walls have the shape generally of D's with the straight edges of said D's being held substantially adjacent to each other and said D's are connected to each other.

3. The dispenser of claim 2 further including holding means, coupled to said tubes, for holding a cap in a position relative to said tubes to close said openings in said one ends of said tubes.

4. The dispenser of claim 3 wherein said tubes have a composition of a thermoplastic.

5. The dispenser of claim 4 wherein said tubes are held together.

6. The dispenser of claim 5 wherein said holding means includes a thread attached to said one ends of said tubes near said openings.

7. The dispenser of claim 6 wherein said one ends are formed integrally with the remainder of said tubes.

8. The dispenser of claim 7 wherein said tubes, at their outer peripheries, have a space between each other at said one ends of said tubes, and further including a stiffening rib between said outer peripheries of said tubes in the vicinity of said thread.

9. The dispenser of claim 7 wherein said two tubes are formed integrally with each other.

10. The dispenser of claim 9 wherein said thread is helical.

11. The dispenser of claim 5 wherein said two tubes are formed integrally.

12. The dispenser of claim 11 wherein said tubes are blow molded.

13. The dispenser of claim 12 wherein said elongated tubes are adjoined to each other along a line running in the general direction of their elongated dimension and located in the vicinity of the center of said dispenser.

14. The dispenser of claim 13 wherein said tubes are extruded-blow molded.

15. The dispenser of claim 14 wherein the other end of each of said tubes is closed and said other ends are held together.

16. The dispenser of claim 15 wherein said ends are sealed together.

17. The dispenser of claim 16 wherein said other ends are heat sealed together.

18. The dispenser of claim 17 wherein said thermoplastic comprises polyethylene, polypropylene, polyethylene terephthalate, or polyvinyl chloride.

19. The dispenser of claim 18 wherein the walls of said tubes are multilayered.

20. The dispenser of claim 5 wherein said taper generally takes the shape of a sloping curve.

21. The dispenser of claim 20 wherein said holding means includes screw threads located between said taper and said other ends.

22. The dispenser of claim 5 wherein said holding means includes screw threads located between said taper and said other ends.

23. A dispenser comprising:

(A) a cap having:

(1) a first section having an opening therethrough;

(2) a second section including closure means for when said second section is in a first position relative to said first section, closing said opening through said first section; and (3) coupling means, coupled to said first and second sections, for holding said second section in said first position and for permitting movement of said second section relative to first section, said second section leaving said opening open when in said second position;

(B) a dual-tube container having two elongated tubes held in close proximity to each other with their elongated dimensions alongside each other, one end of each of said tubes having an opening, each of said tubes tapering to said opening; and (C) affixation means, coupled to said tubes and said cap, for holding said first section of said cap to said tubes at a location near said ends of said tubes with said openings in said one ends of said tubes passing substantially through said opening in said first section of said cap when said affixation means holds said first section at said location.

24. The dispenser of claim 23 wherein each of said openings is defined by a wall having an exterior surface, said exterior surfaces of said walls have the shape generally of D's, with the straight edges of said D's being held substantially adjacent to each other, and said D's are connected to each other.

25. The dispenser of claim 24 wherein said tubes have a composition of a thermoplastic.

26. The dispenser of claim 25 wherein said one ends of said tubes extend substantially all the way through said opening in said first section of said cap.

27. The dispenser of claim 26 wherein said tubes are held together.

28. The dispenser of claim 27 wherein said affixation means includes a thread attached to said one ends of said tubes near said openings.

29. The dispenser of claim 28 wherein said cap has a thread matching said thread on said tubes.

30. The dispenser of claim 29 wherein said one ends are formed integrally with the remainder of said tubes.

31. The dispenser of claim 30 wherein said affixation means includes screw threads located between said taper and said other ends.

32. The dispenser of claim 31 wherein said tubes, at their outer peripheries, have a space between each other at said one ends of said tubes, and further including a stiffening rib between said outer peripheries of said tubes in the vicinity of said thread.

33. The dispenser of claim 32 wherein said two tubes are formed integrally with each other.

34. The dispenser of claim 33 wherein said thread is helical.

35. The dispenser of claim 34 wherein said first section of said caps screws onto said first ends of said elongated tubes.

36. The dispenser of claim 27 wherein said two tubes are formed integrally.

37. The dispenser of claim 36 wherein said tubes blow molded.

38. The dispenser of claim 37 wherein said elongated tubes are adjoined to each other along a line running in the general direction of their elongated dimension and located in the vicinity of the center of said dispenser.

39. The dispenser of claim 38 wherein said tubes are extruded-blow molded.

40. The dispenser of claim 39 wherein the other end of each of said tubes is closed and said other ends are held together.

41. The dispenser of claim 40 wherein said ends are sealed together.

42. The dispenser of claim 41 wherein said taper generally takes the shape of a sloping curve.

43. The dispenser of claim 42 wherein said other ends are heat sealed together.

44. The dispenser of claim 43 wherein said thermoplastic comprises polyethylene, polypropylene, polyethylene terephthalate, or polyvinyl chloride.

45. The dispenser of claim 44 wherein the walls of said tubes are multilayered.

46. The dispenser of claim 45 wherein said first and second sections of said cap are hinged together.

47. The dispenser of claim 34 wherein said taper is a gentle taper.

48. A dual-compartment tube comprising:

(A) two elongated tubes attached together along their elongated dimensions, one end of each of said tubes having an opening with said openings lying generally near to each other; and (B) a common chamber attached to and having a fluid-tight passage to the other ends of both of said tubes.

49. The tube of claim 48 wherein said elongated tubes have a composition of a thermoplastic.

50. The tube of claim 49 wherein said chamber has a composition of a thermoplastic.

51. The tube of claim 50 wherein said elongated tubes are formed integrally with each other.

52. The tube of claim 51 further including holding means, coupled to said elongated tubes, for holding a cap in a position relative to said elongated tubes to close said openings in said one ends of said tubes.

53. The tube of claim 52 wherein said chamber is formed integrally with said elongated tubes.

54. The tube of claim 53 wherein said elongated tubes taper to said one ends of said elongated tubes.

55. The tube of claim 54 wherein said holding means includes a thread attached to said one ends of said elongated tubes near said openings.

56. The tube of claim 55 wherein said one end of each of said elongated tubes has an opening defined by a wall with an exterior surface in the shape generally of a D, with the ends of said D's lying generally in a plane with the straight edge of said D's of said elongated tubes being held substantially adjacent to each other.

57. The tube of claim 56 wherein said thread is helical.

58. The tube of claim 56 wherein said holding means includes screw threads located between said taper and said other ends.

59. The tube of claim 58 wherein said elongated tubes, at their outer peripheries, have a space between each other at said one ends of said elongated tubes, and further including a stiffening rib between said outer peripheries of said elongated tubes in the vicinity of said thread.

60. The tube of claim 59 wherein said one ends are formed integrally with the remainder of said elongated tubes and said D's are connected to each other.

61. The tube of claim 60 wherein said taper is a gentle taper.

62. The tube of claim 61 wherein said taper generally takes the shape of a sloping curve.

63. The tube of claim 52 wherein said thermoplastic comprises polyethylene, polypropylene, polyethylene terephthalate, or polyvinylchloride.

64. The tube of claim 63 wherein the walls of said elongated tubes are multilayered.

65. The tube of claim 52 wherein said elongated tubes are blow molded.

66. The tube of claim 65 wherein said elongated tubes are extruded-blow molded.

67. The tube of claim 65 wherein said elongated tubes are adjoined to each other along a line running in the general direction of their elongated dimension and located in the vicinity of the center of said tube.

* * * * *